US008195453B2

(12) United States Patent
Cornell et al.

(10) Patent No.: US 8,195,453 B2
(45) Date of Patent: Jun. 5, 2012

(54) DISTRIBUTED INTELLIGIBILITY TESTING SYSTEM

(75) Inventors: John Cornell, Vancouver (CA); Shelia McFarland, Vancouver (CA)

(73) Assignee: QNX Software Systems Limited, Kanata, Ontario (CA)

( * ) Notice: Subject to any disclaimer, the term of this patent is extended or adjusted under 35 U.S.C. 154(b) by 1300 days.

(21) Appl. No.: 11/854,728

(22) Filed: Sep. 13, 2007

(65) Prior Publication Data

US 2009/0074195 A1 Mar. 19, 2009

(51) Int. Cl.
*G10L 11/00* (2006.01)
*G10L 21/02* (2006.01)

(52) U.S. Cl. ..... 704/226; 704/233

(58) Field of Classification Search ..... None
See application file for complete search history.

(56) References Cited

U.S. PATENT DOCUMENTS 6,876,966 B1 * 4/2005 Deng et al. ..... 704/233
7,103,540 B2 * 9/2006 Droppo et al. ..... 704/226
7,143,031 B1 * 11/2006 Ahroon ..... 704/224
7,174,292 B2 * 2/2007 Deng et al. ..... 704/226
7,289,955 B2 * 10/2007 Deng et al. ..... 704/226
7,370,057 B2 * 5/2008 Burdick et al. ..... 707/692
7,725,315 B2 * 5/2010 Hetherington et al. ..... 704/233
7,895,036 B2 * 2/2011 Hetherington et al. ..... 704/233
2005/0114128 A1 * 5/2005 Hetherington et al. ..... 704/233
2006/0045281 A1 * 3/2006 Korneluk et al. ..... 381/60
2006/0251268 A1 * 11/2006 Hetherington et al. ..... 381/94.1

* cited by examiner

*Primary Examiner* — Talivaldis Ivars Smits
(74) *Attorney, Agent, or Firm* — Brinks Hofer Gilson & Lione

(57) ABSTRACT

A distributed intelligibility testing system provides standardized audio tests to a plurality of remotely located client systems. The testing system includes a test manager that records a plurality of audio test words based on established intelligibility standards and generates a test protocol corresponding to the audio test words. A database receives and stores the audio test words and the test protocol. The audio test words are stored as a plurality of audio test files. Respective client systems in communication with the database receive and play the audio test files in accordance with the test protocol. The client systems record test responses when the audio test files are played. The test responses are stored in a database, and then evaluated.

24 Claims, 11 Drawing Sheets

| Attribute (Distinctive Feature) | | | | | |
|---|---|---|---|---|---|
| **Voicing** | **Nasality** | **Sustention** | **Sibilation** | **Graveness** | **Compactness** |
| veal - feel | meat - beat | vee - bee | zee - thee | weed - reed | yield - wield |
| bean - peen | need - deed | sheet - cheat | cheep - keep | peak - teak | key - tea |
| gin - chin | mitt - bit | vill - bill | jilt - gilt | bid - did | hit - fit |
| dint - tint | nip - dip | thick - tick | sing - thing | fin - thin | gill - dill |
| zoo - sue | moot - boot | foo - pooh | juice - goose | moon - noon | coop - poop |
| dune - tune | news - dues | shoes - choose | chew - coo | pool - tool | you - rue |
| voal - foal | moan - bone | those - doze | joe - go | bowl - dole | ghost - boast |
| goat - coat | note - dote | though - dough | sole - thole | fore - thor | show - so |
| zed - said | mend - bend | then - den | jest - guest | met - net | keg - peg |
| dense - tense | neck - deck | fence - pence | chair - care | pent - tent | yen - wren |
| vast - fast | mad - bad | than - dan | jab - dab | bank - dank | gat - bat |
| gaff - calf | nab - dab | shad - chad | sank - thank | fad - thad | shag - sag |
| vault - fault | moss - boss | thong - tong | jaws - gauze | fought - thought | yawl - wall |
| daunt - taunt | gnaw - daw | shaw - chaw | saw - thaw | bond - dong | caught - taught |
| jock - chock | mom - bomb | von - bon | jot - got | wad - rod | hop - fop |
| bond - pond | knock - dock | vox - box | chop - cop | pot - tot | got - dot |

Figure 3

| |
|---|
| Mary had a little lamb |
| Humpty Dumpty had a great fall |
| Jack and Jill went up the hill |
| This little piggy went to market |
| There was an old man who lived in a shoe |
| Little Bo Peep has lost her sheep |
| Three blind mice, see how they run |
| Twinkle, twinkle, little star |
| The Farmer in the dell |
| Jack be nimble, Jack be quick |
| Little Miss Muffet sat on a tuffet |
| One, two, buckle my shoe |
| Peter, Peter, pumpkin eater |
| Row, row, row your boat |
| Mary, Mary, quite contrary |
| Do you know the Muffin Man |
| One a penny, two a penny |
| Humpty Dumpty sat on a wall |
| Now I lay me down to sleep |
| Old MacDonald had a farm |
| Pop! goes the weasel |
| Rain, rain go away |
| She'll be comin' round the mountain |
| Star light, star bright |
| This little piggy stayed home |
| This little piggy had roast beef |
| I've been workin' on the railroad |
| London Bridge is fallin' down |
| Rudolph the red nosed reindeer |
| Twas the night before Christmas |
| Ding, dong, the witch is dead |
| Rain drops keep falling on my head |
| I'm a little teapot |
| Puff, the magic dragon |
| It's been a hard days night |
| We all live in a yellow submarine |
| Jimmy cracked corn and I don't care |
| Good golly Miss Molly |
| Frankly my dear I don't give a damn |
| There's no business like show business |
| Splish splash I was taking a bath |
| Another one bites the dust |
| I heard it through the grape vine |
| These boots were made for walking |

Figure 4

DISTRIBUTED INTELLIGIBILITY TESTING SYSTEM

BACKGROUND OF THE INVENTION

1. Technical Field

This disclosure relates to testing speech intelligibility, and in particular to testing the speech intelligibility using remotely located client systems.

2. Related Art

Speech intelligibility testing may determine the effectiveness of various noise reduction systems. People may listen to recorded words or phrases that are processed to remove noise or compensate for transmission deficiencies. A test subject may select between two word choices on a display screen that correspond to a spoken utterance. A high correlation between the spoken word and the correct displayed choice may indicate high intelligibility. Conversely, a low correlation between the spoken word and the correct displayed choice may indicate low intelligibility.

Speech intelligibility testing may be performed in a controlled audio environment. The test subject may be required to travel to a central location to participate in the test. This may cause work disruption and may increase the cost of such testing. Test samples may be needed from a large number of test takers to provide meaningful statistical results. It may be difficult and time-consuming to efficiently schedule the required number of test-takers.

SUMMARY

A distributed intelligibility testing system provides standardized audio tests to a plurality of remotely located client systems. The testing system includes a test manager that records a plurality of audio test words and generates a test protocol corresponding to the audio test words. A database receives and stores the audio test words and the test protocol. The audio test words are stored as a plurality of audio test files. Respective client systems in communication with the database receive and play the audio test files in accordance with the test protocol. The client systems record test responses when the audio test files are played. The test responses are stored in the database, and then evaluated.

Other systems, methods, features, and advantages will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

FIG. 3 shows test words according to a first test regimen.

FIG. 4 shows test phrases according to a second test regimen.

DETAILED DESCRIPTION OF THE PREFERRED EMBODIMENTS

Figure 1:
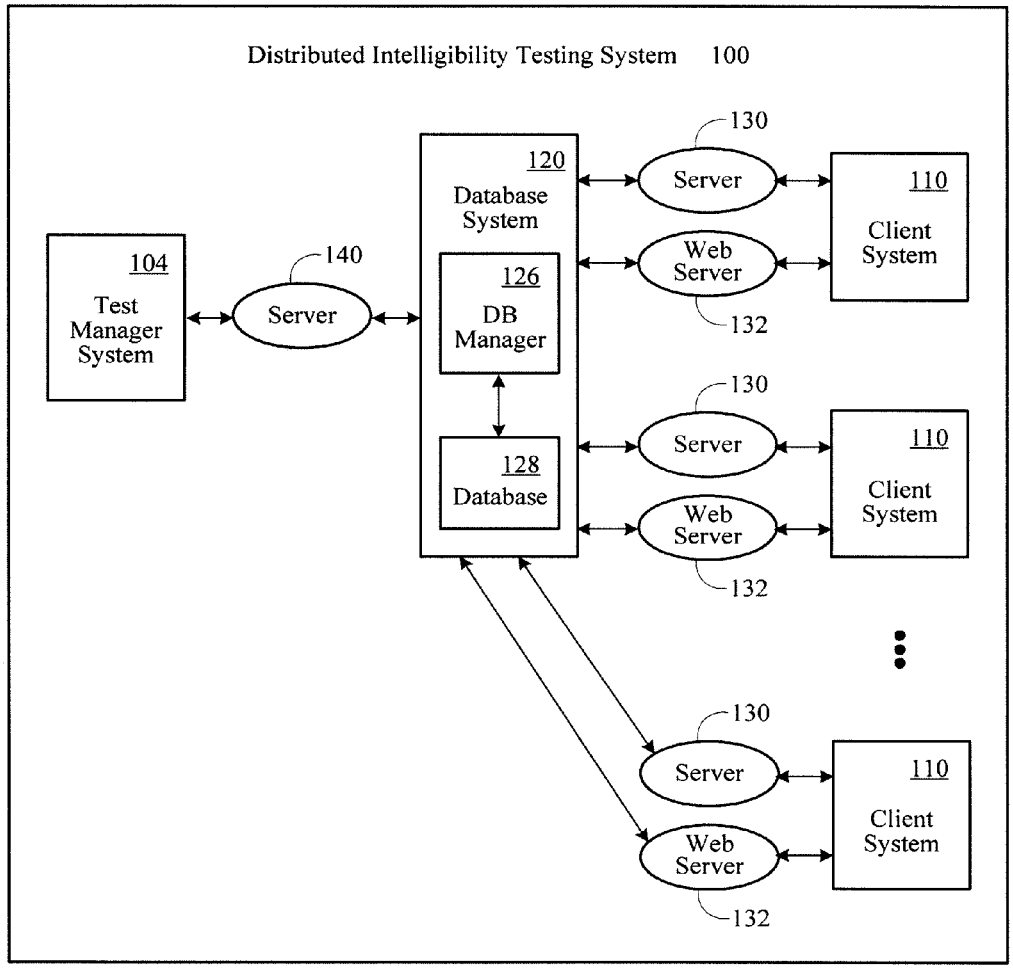
FIG. 1 is a distributed intelligibility testing system.

FIG. 1 is a distributed intelligibility testing system 100 that may include a test manager system 104, a plurality of client systems 110, and a database system 120. The database system may include a database manager 126 and a database 128. The database system 120 may communicate with the plurality of client systems 110 through corresponding local servers 130 and/or web servers 132. The test manager system 104 may communicate with the database system 120 through a remote server 140. The test manager system 104 may provide standardized audio tests to the client systems 110 via the database system 120. Because test results from a large number of client systems 110 or test takers may be needed to provide meaningful statistical results, a large number of client systems 110 may be included.

Figure 2:
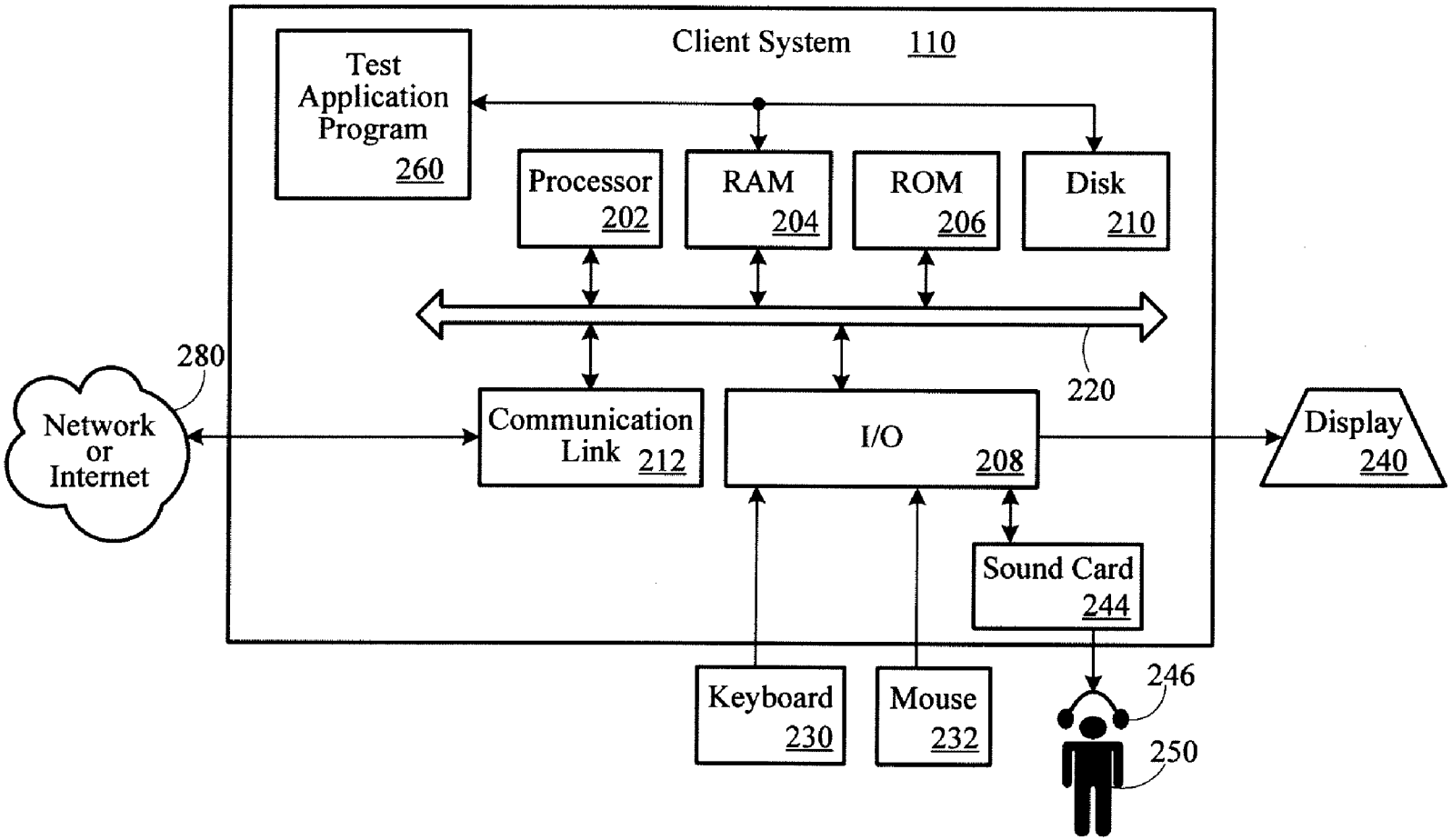
FIG. 2 is a client system.

FIG. 2 is the client system, which may be a personal computer, work station, or other computing system. The client system 110 may include components such as a processor 202, RAM 204, ROM 206, Input/Output 208, disk storage 210, and a communication link 212. The components may be interconnected through a common bus 220. The respective client system 110 may include a keyboard 230 and a mouse 232 or other input devices, a display screen 240, a sound card 244, and a headphone set 246 connected to the sound card. The sound card 244 may be a SOUNDBLASTER card manufactured by Creative Labs, Inc.

The sound card 244 may be a Universal Serial Bus (USB) device adapted to plug into and play with the client system 110. The headphone set 246 may connect to the sound card 244. The headphone set 246 may be a high quality headphone set having superior noise isolation and sound reproduction properties. The headphone set 246 may be a closed-ear stereophonic headphone set, model AKG271, manufactured by AKG Acoustics, U.S., of California. Each client system 110 may be provided with standardized equipment, such as the sound card 244 and headphone set 246 to provide a normalized remote testing environment. A client 250 or human test-taker may wear the headphone set 246 during the testing period.

The standardized audio testing may be used to determine the effectiveness of certain audio processing or noise reduction techniques, or revisions of such techniques, whether hardware or software-based. Such audio processing or noise reduction techniques may counteract or reduce environmental noise or audio transmission deficiencies. For example, wireless telephone transmissions may be subject to bandwidth limiting effects, echoes, and may be subject to environmental noise heard in a vehicle interior. Such noise may include fan noise, blower noise, rain noise, wind buffets, engine noise, road noise, windshield wiper noise, tire noise, and other noise.

To improve the intelligibility of such wireless telephone transmission, various hardware and software processing and noise reduction techniques may be used. Such techniques may include echo-cancellation, echo-suppression, gain level adjustment, bandwidth extension, dynamic range modification, and other techniques. The effectiveness of the applied audio processing or noise-reduction technique may be proportional to or reflected by a level of intelligibility of the audio test words processed by those techniques. To measure the effectiveness of these techniques, the client 250 may determine the intelligibility of spoken words. The results may indicate the intelligibility of the audio samples, and thus indicate the effectiveness of the technique.

The test manager system 104 may provide a plurality of audio tests to the remotely located client systems 110. The client 250 need not travel to a central location to participate in the test. Valuable resources, such as office space, facilities, and equipment, need not be tied up or otherwise under-utilized at a central testing location. Because many employees have access to a personal computer or work station at his or her desk, no additional equipment may be needed to run the intelligibility tests.

The test-taker or human client 250 using the client system 110 may participate in a Diagnostic Rhythm Test (DRT), a Terminal Consonant Counterpart of the DRT, a Comparison Mean Opinion Score test (CMOS test), a modified CMOS test, or another test, depending upon the system and the results sought. The DRT may use common, monosyllabic English words, almost all of which have three sounds in a consonant-vowel-consonant sequence. Speech intelligibility may be measured by comparing monosyllabic words that trained listeners (the client 250) receive to those words the client identifies. The DRT is governed by a document entitled "The American National Standard for Measuring the Intelligibility of Speech over Communication Systems," (ANSI S3.2-1989), which is incorporated by reference.

The DRT may include 192 words arranged in 96 pairs, with words in each pair differing only in their initial consonants (e.g., pot-tot, vox-box). FIG. 3 shows the DRT test words. During the test, the client 250 may choose the correct word when one of the words are presented audibly. A carrier or "context" sentence is not provided, and the correct word is always presented. A visual presentation of a listener's alternative responses may be shown on the display screen, including the stimulus word, and may be displayed to the listener 250 prior to the auditory presentation of the stimulus word.

The visual presentation of the words may be random, and the audio presentation may be chosen randomly from either the first or the second word of the word pair to distribute the results evenly and to circumvent any potential learning effects. The audio presentation sequence may differ for each listener to ensure that judgments are dependent upon the audio impairment rather than on the sequence of words presented.

Because the stimulus words differ only in their initial consonant, the DRT results may reveal signal errors in the initial consonant only. The DRT is based on the following distinctive features of speech:

1. voicing (e.g., veal v. feel)
2. nasality (e.g., need v. deed)
3. sustention (continuity rather than interruption, e.g., vee v. bee)
4. sibilation (strong, high-frequency aperiodicity, e.g., cheap v. keep)
5. graveness (articulation at the lips, resulting in a weak, dominantly low-frequency or flat spectrum, e.g., weed v. reed)
6. compactness (place of articulation resulting in mid-frequency spectral emphasis, e.g., yen v. wren)

The DRT may be scored both by averaging the results over some or all major diagnostic categories (i.e., distinctive feature) for each listener, and/or by computing averages for each category. The DRT test may be administered in stages to minimize learning effects and ensure that listeners are not overloaded to the point of reduced accuracy of judgment. Each client 250 may be limited to sessions that are about ten minutes to about twenty minutes in length.

In the DRT, the speech samples may be divided into a low noise group and a high noise group. The samples may be randomized and presented to each client 250 or listener in two or more separate tests. Several speakers may be included in each set. The speakers may vary by age and/or gender.

CMOS testing is described in a publication entitled "ITU-T Recommendation P.800, Annex E," which is incorporated by reference. Other testing protocol may be described in a publication entitled "ITU-T Recommendation BS.1116-1," which is incorporated by reference. The client 250 may be presented with pairs of speech samples or speech phrases. FIG. 4 shows the CMOS test phrases. The presentation order may be randomized to circumvent learning effects. The client 250 may use a scale to judge the quality of the second sample relative to the first, ranging from −3 through 0 to +3 for "much worse" through "not much difference" to "much better," respectively. The clients 250 or listeners may provide two judgments: 1) which sample has better quality and 2) by how much the quality is better. The quantity evaluated from the scores is referred to as the comparison mean opinion score (CMOS). The same raw speech samples may be subjected to two different processing methods, and the results may include the speech sample pairs presented to the client 250 in random order.

A modified approach to CMOS may be used to account for inherent variability in listener judgment. Users may be unreliable and inconsistent in subjective judging of audio samples in real-world situations because they may be sensitive to a plurality of factors other than the factors of interest. Part of this variability and inconsistency may be due to differences in individual understanding of the measurement scales, that is, what constitutes "much worse" as opposed to "somewhat worse." Other variability and inconsistency may be based on the differences in the understanding of one particular individual over time and between tests. It may be difficult to place a meaningful value on a response, such as how strong a preference is or how large a difference is. Even if scales are communicated to the client, such scales can vary in a group and/or for specific individuals over time.

Normalization of the overall results may be performed using experimental methods. However, for small groups of listeners, the data analysis may not be adequately corrected. There may be benefits to make the subjective test as simple as possible. A simpler test may result in more reliable test results.

Accordingly, a modified CMOS test may be administered where each client or listener judges which sample is preferred, such as sample A or sample B. The results may be analyzed relative to various ratios of preference B over the total. The modified CMOS test may use common English phrases from nursery rhymes, popular music, and popular movies, as shown in FIG. 45. The clients 250 may recognize these phrases easily, allowing them concentrate on the differentiation of acoustic nuances between the speech samples, rather than on recognition of the words they are hearing.

The audio presentation of the speech phrases may be randomized to minimize learning effects, and distribute the results when no preference is found. As with the DRT, each listener may receive a different presentation order so that the judgments made are dependent only upon the different levels of impairments in the speech samples presented.

Other tests, such as a RCMOS test (Reverse CMOS), may be administered. In CMOS testing, a "repeat" button may be undesirable due to listener adaptation, which may bias the results. Eliminating a repeat button or function may ensure the randomization of playback order (the output from process A versus process B). This may account for hearing adaptation to spectral or frequency content, particularly for spectral or frequency content in male or female voices. For example, consider the situation where audio output files may include a male voice followed by a female voice, processed by process A and process B. In this situation, for one particular test case, the listener is supposed to hear the following: "M1 F1 short pause M2 F2."

In the above example, the main comparison time region for the CMOS test is composed of "F1 M2." If the listener could repeat the test, the listener may hear the following: "M1 F1 short pause M2 F2 short pause M1 F1 short pause M2 F2." In such a situation, it may not be possible to determine if the listener makes their assessment based on the "F1 M2" region or the "F2 M1" region, as it may depend on what part of this long sequence caught the listener's attention. Because in this example the assessment order was intended to be "process A process B," use of a repeat button could potentially degrade or destroy the playback randomization, and bias the statistics.

The RCMOS test may be used to address this potential problem. In the RCMOS test, every audio pair may be played twice, but the order of playback may be reversed during the second playback. The listener may make a second decision on the audio pair in a blinded fashion. If the order were not reversed, the statistics could be artificially biased in favor of the process that was favored overall. By reversing the order, the score between the processes may be evened or smoothed directly by permitting the listener make an additional choice. Alternatively, this may increase the number of "no difference" choices, which may indirectly even or smooth the score because the answers may be split between the two processes, namely process A and process B.

Figure 5:
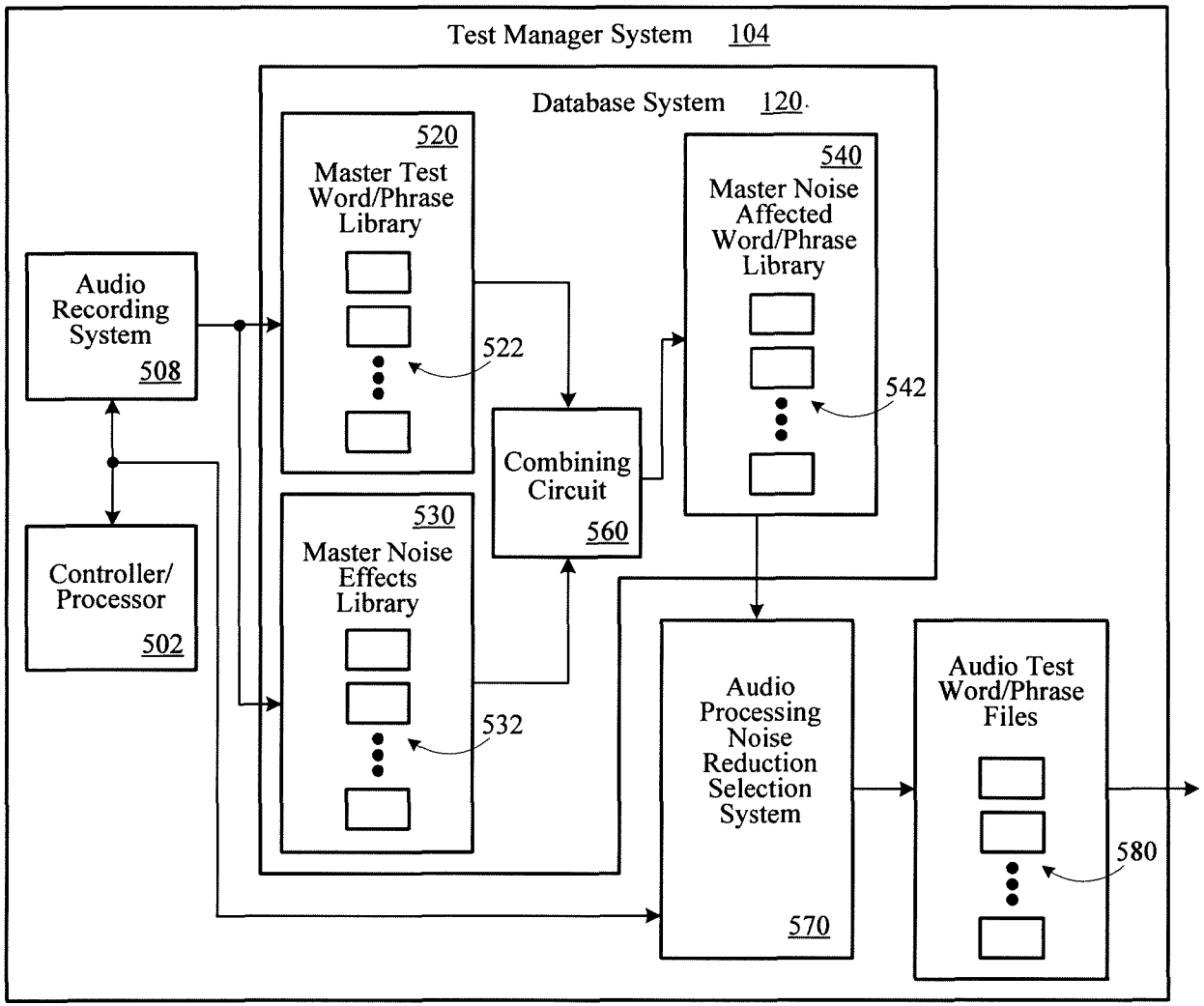
FIG. 5 is test manager system.

FIG. 5 is the test manager system 104. The test manager system 104 may include a controller 502, such as a microcontroller or personal computer, a digital audio recording system 508, and the database system 120. The database system 120 may contain a plurality of sound recording libraries. The database system 120 may be a structured query language (SQL) type database, or other database. The sound recording libraries may include a master test word library 520 having a plurality of master test word files 522, a master noise effects library 530 having a plurality of master noise effects files 532, and a master noise-affected test word library 540 having a plurality of master noise-affected test word files. The libraries or sound recording may not be limited to "words" and may also include phrases or sentences, depending upon the test implemented. The database may include a sub-language that may be used in querying, updating or managing relations.

The files may be digital audio files stored in WAV format, or another format may be used depending on the system. A combining circuit 560 may combine or convolute a file 522 in the master test word library 520 with a file 532 in the master noise effects library 530 to generate a file 542 in the master noise-affected test word library 540. An audio processing/noise reduction selection system 570 may apply various hardware and software techniques/logic to the master noise-affected test word file 542 to generate various audio test files 580, which may be downloaded to the respective client systems.

An administrator may create the test sequences and test "questions" using the audio test file. The administrator may use the test manager system 104 to create and store the master test word files 522, the master noise effects files 532, the noise-affected test word files 542, and the audio tests files 580. The client system 110 may download a subset of the audio test files 580. Alternatively, the master test word files 522 may be obtained from an existing master source or may be initially created depending upon the system and the status of the various testing protocols to be implemented. To implement the various tests such as DRT and CMOS test, each client system 110 may install and/or launch a test application program 260.

Each client system 110 may belong to a specific "listening group." A listening group may identify or associate a plurality of clients 250 or client systems 110 eligible to participate in certain tests. Listening groups may be established by the geographical area in which the client systems are located or may be established according to other criteria.

Figure 6:
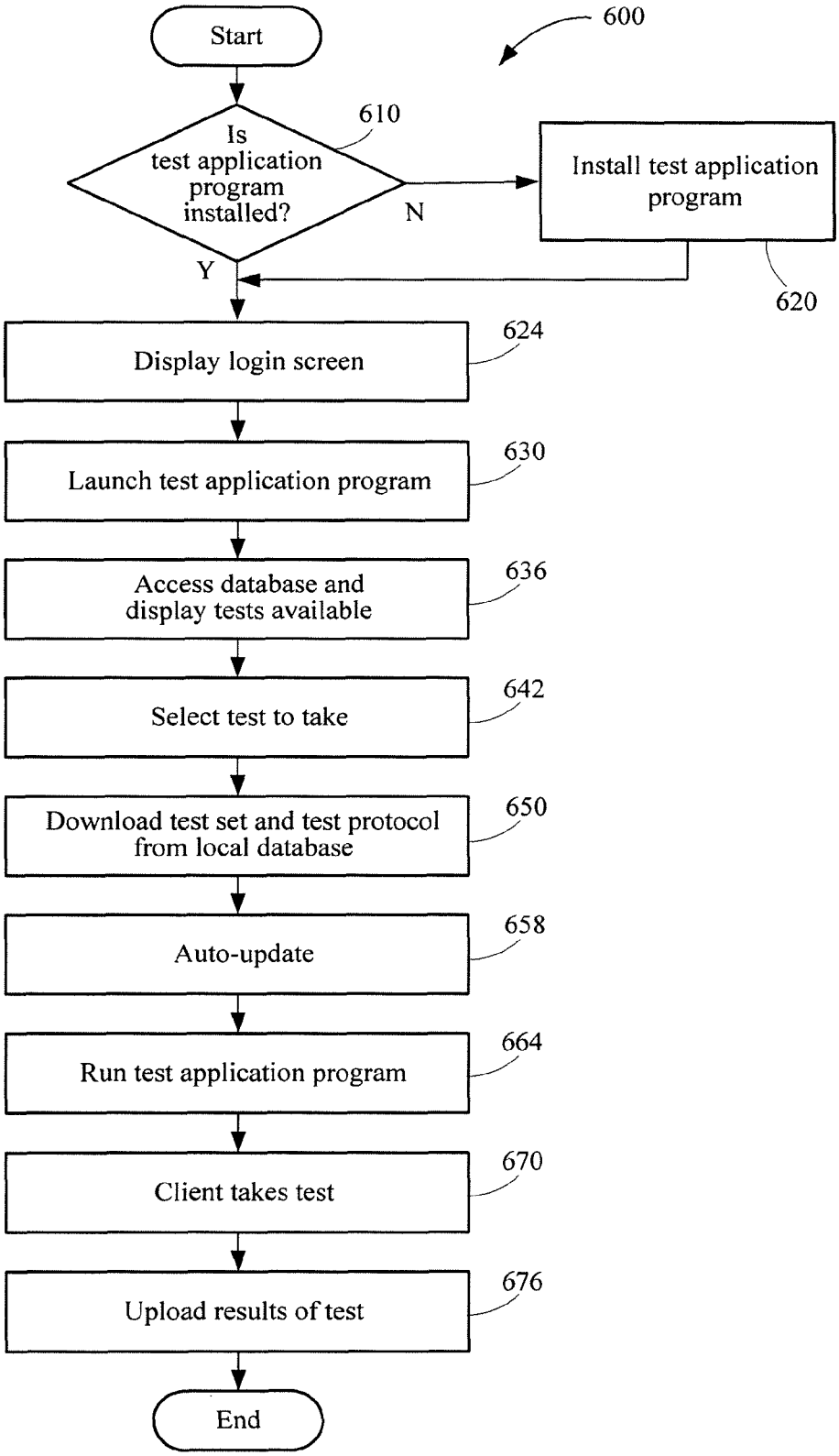
FIG. 6 is a test application process.
Figure 7:
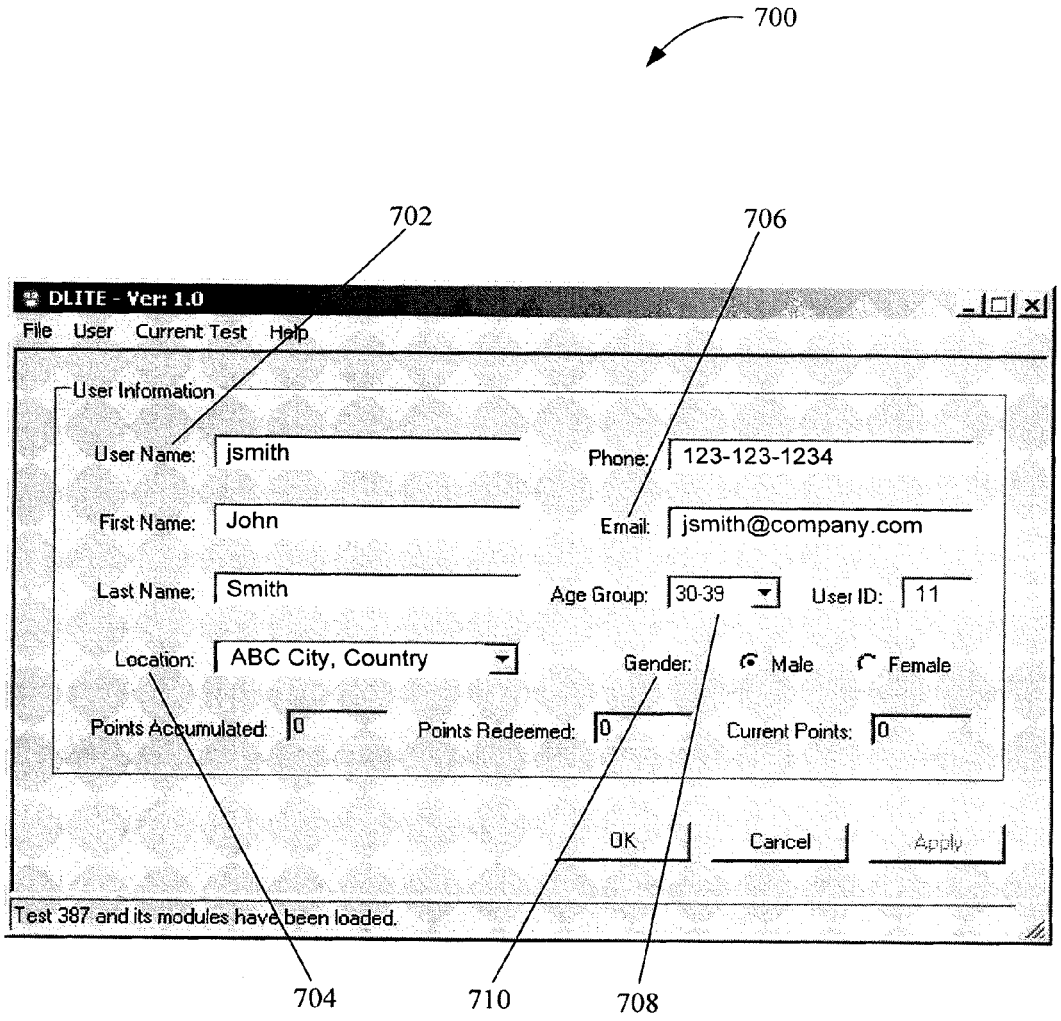
FIG. 7 is a login screen image.

FIG. 6 shows a test application process 600, which may execute on the client system 110. The client system 110 may check to determine if the test application program is installed on the client system (Act 610). The client 250 may install the test application program 260 if it is not installed (Act 620). If the test application program 260 is installed, the client system 110 may launch the test application program (Act 630). The test application program 260 may display an image of a login screen to the client (Act 624). The login screen 700 is shown in FIG. 7. The client may type in a user name 702, location 704, email address 706, age 708, gender 710, or other pertinent information. This information may be kept on file and associated with the user name 702 or user name for existing clients. Once the client 250 is logged in and authenticated, the client system 110 may access the database system 120 over the Internet 280 via a local server 130 or a web server 132 (Act 636) to obtain the test audio files and testing protocol file.

Figure 8:
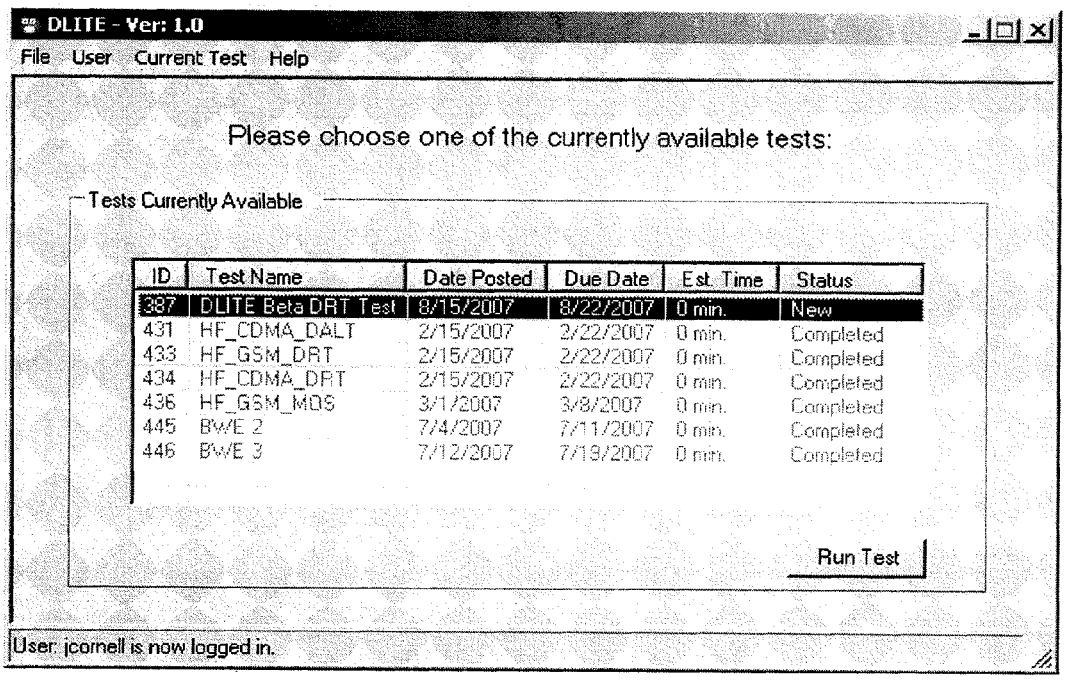
FIG. 8 is a test selection screen image.

The application test program 260 may display a choice of tests that may be available to the client 250 based on the particular listener group to which the client system is associated (Act 642). FIG. 8 show some of the tests that may be available to the client system 110 and may list the tests that have been completed. Once the client selects a test (Act 642), the test application program 260 may download the digital audio test files from the local server 130 or a server located closest to the client system (Act 650) to minimize download time.

The application test program 260 may perform an auto-update function to determine whether the most recent version of the test was selected (Act 658) from the local server 130. If the application test program determines that a more current version of the test exists, the current version may be downloaded from the database system 120 and stored on the local server 130 to be used for the current test and/or for subsequent test-takers. Once downloaded, the selected test may be run (Act 664). The client 250, using the client system 110, may then take and complete the test (Act 670). After the client completes the test, the application test program 260 may upload the results of the test to either the local server or to the database system 120 through another server (Act 676).

Figure 9:
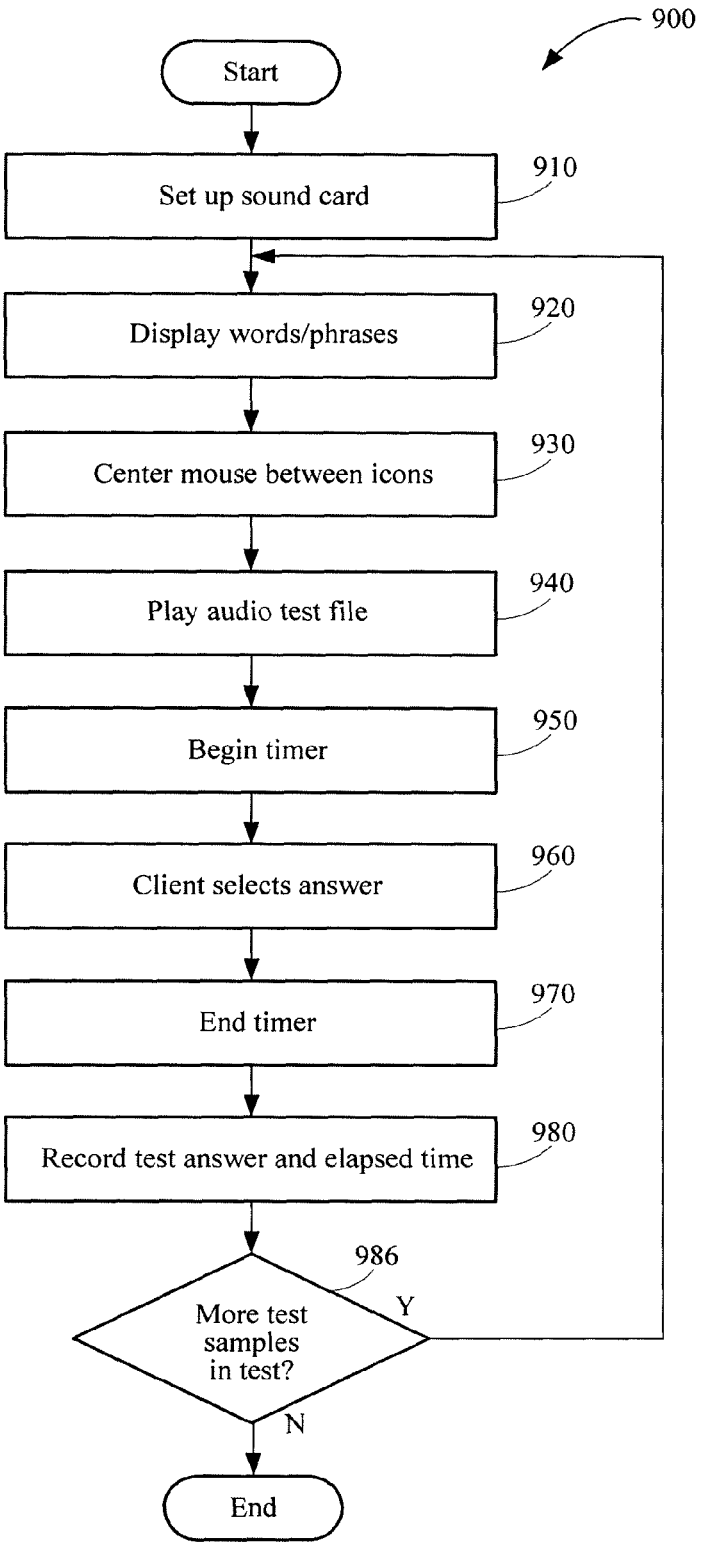
FIG. 9 is a process to execute a test.

FIG. 9 shows the process for executing the selected test (Act 664). The application test program 250 may set the parameters of the test based on the associated test protocol file (Act 910). The application test program 250 may control the sound card to set the volume level of the audio output signal to about 75%. The application test program 250 may flatten the base and treble frequency response and turn off audio effects, such as surround sound. The application test program may also lock the user's volume control so that the user cannot modify the volume level. This may ensure uniform testing conditions across all testing platforms. The application test program 250 may then display the first word pair on the display screen, if a DRT—type test has been selected (Act 920).

Figure 10:
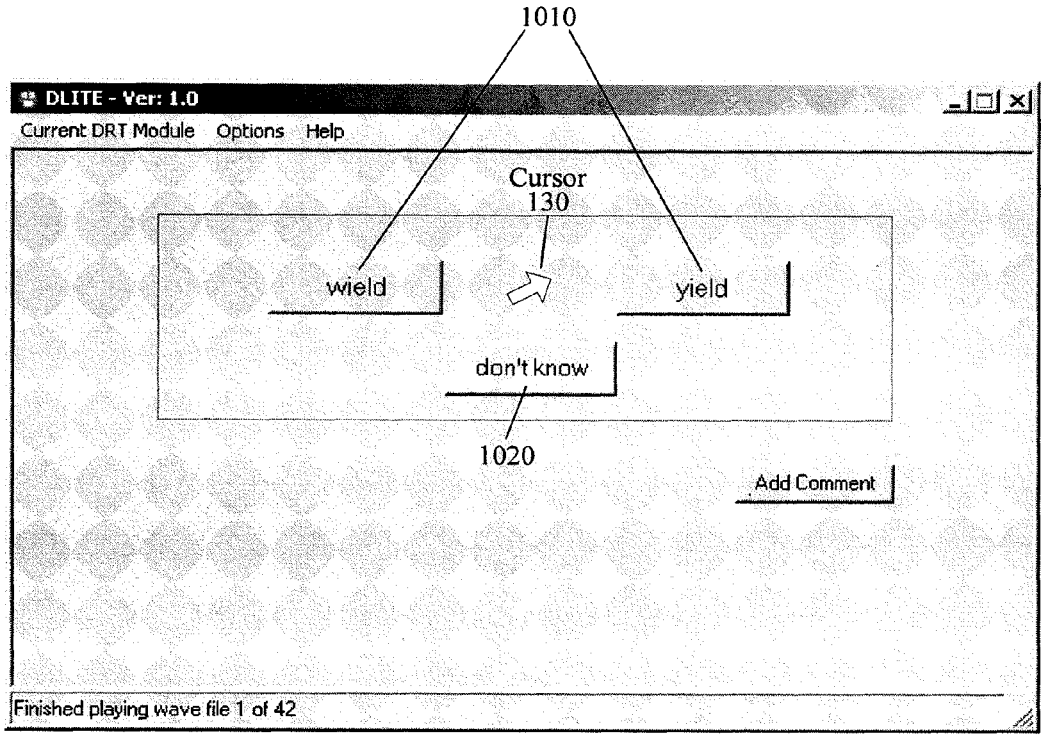
FIG. 10 is a word test choice screen image.

FIG. 10 is a screen image showing a DRT in progress. In the example of FIG. 10, the word pair 1010 "wield" and "yield" may be displayed on the screen. The words may appear on the screen for about one to about two seconds prior to playing the audio file corresponding to one of the two words, along with an optional choice of "don't know" 1020. A cursor 1030 or other icon may be displayed on the screen equidistantly centered from each of the display boxes (Act 930) to remove any bias toward a specific icon.

The audio test word file 580 file may then be played through the client's headphone set (Act 940). The applicant test program 260 may then start a timer to time how long the client 250 takes to make his or her choice (Act 950). The client 250 may then choose which of the two words 1010 have been played through the headphone set 216. Using the mouse 232 or other input device, the client 250 may click on the choice that corresponds to the audio output (Act 960). The applicant test program 260 may then stop the timer (Act 970) and record the client's test choice and the time elapsed (Act 980). A longer response time may indicate lower intelligibility of the audio test sample 580. If more test words exist in the test set (Act 986), then the next pair of words is accessed and displayed 920, and the test is repeated using the next word pair. When all word pairs in the particular test have been played, the application test program may end the test. Depending on the test selected, audio phrases rather than words may be output, such as during the CMOS-type test. The term "words" may be used interchangeably with the term "phrases." The client 250 may be limited to taking one test in a specified period of time. For example, the test protocol may limit the test duration to about 20 minutes so that the client 250 or test-taker does not become fatigued.

The output of the distributed intelligibility testing system 100, that is, what the client 250 hears, may be processed to simulate psycho-acoustic equivalence with a particular technology. Such technology is not limited to a network implementation, and the testing system 100 may simulate "low fidelity" sound that the client 250 may hear over a landline handset, for example. The output signals provided to the high fidelity stereo headphone set 246 can be processed so that it may be psycho-acoustically equivalent to a low fidelity output provided by a landline handset.

The distributed intelligibility testing system 100 may be used in acoustic software product development. Engineering personnel may develop processes or algorithms that impart effects into audio signals composed of speech and noise background. Such personnel typically listen to the output of their developed process or algorithm through a headphone set so as not to bother others in the office. Such headphone sets may produce a high fidelity output, that is, an accurate and faithful reproduction of the original signal processed by the algorithms. However, in actual use, such signal output may be transmitted through a network, which may include a landline having a low fidelity handset. The distributed intelligibility testing system 100 may be used to simulate both the network and the handset, or any other similar process that operates on the audio signal. This may assist engineering personnel concentrate on removing artifacts and effects of consequence, rather than those artifacts and effects which may not be heard by a listener.

In some systems, the networked employees of a company may participate in the testing procedure. This may be economical because the company essentially has a "captive audience." As an incentive to the employees, "points" may be allocated to each employee participating in the testing process. Each employee may accumulate points and may receive an award, prize, or remuneration of some form when a certain points threshold is reached.

In other systems, the application test program 260 or other program may specify that the client 250 or test-taker must first complete a basic hearing test before being permitted to take the audio test. This may ensure that the client 250 is not hearing-impaired or otherwise unqualified to take the test. The basic hearing test may be administered using the headphone set 246 provided in conjunction with the sound card 244. The basic hearing test may be administered on a periodic basis.

Figure 11:
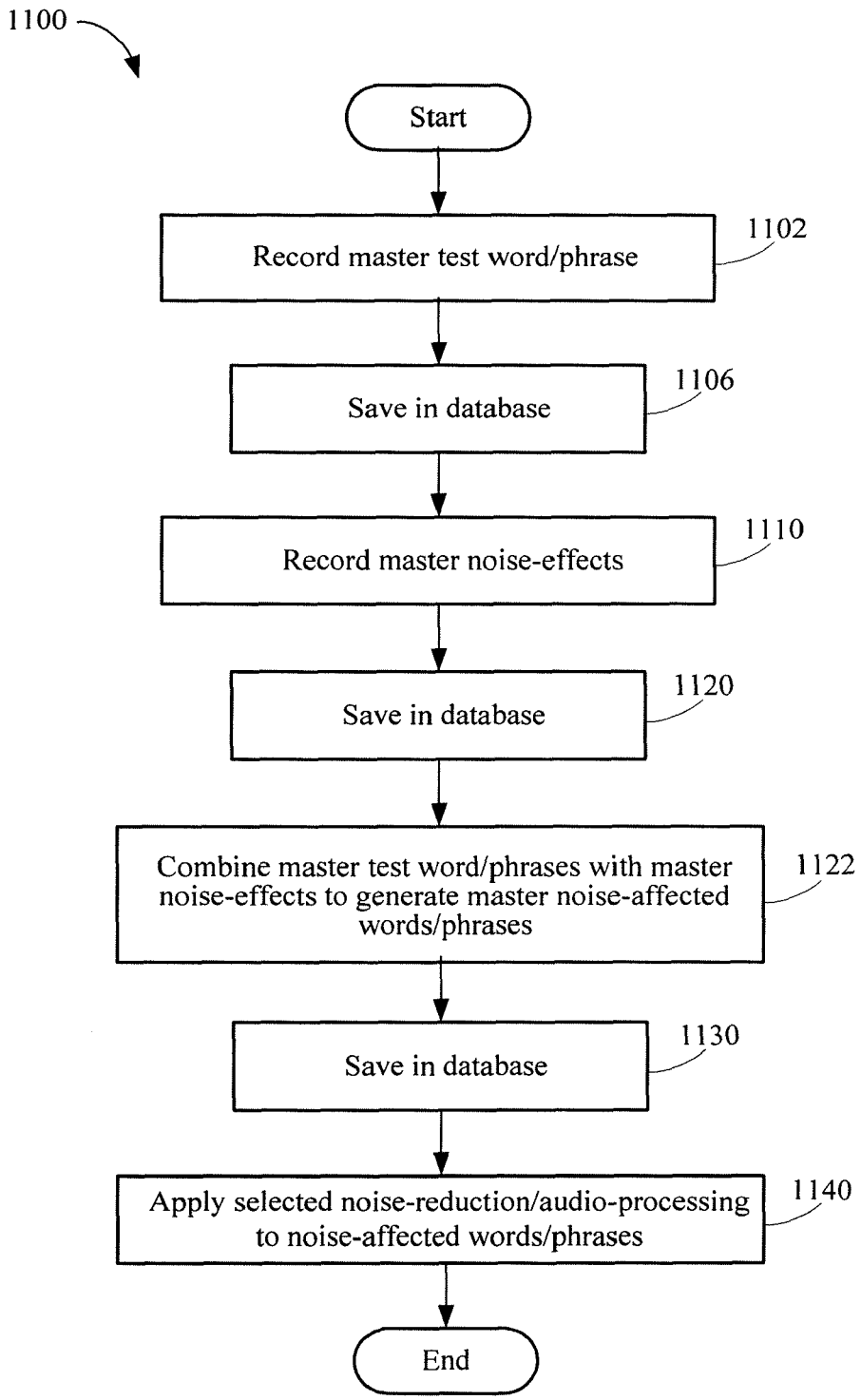
FIG. 11 is a process to generate master word and phrase files.

FIG. 11 is a process to create (1100) the master test word files 522, the master noise effects files, the master noise-effected test word files 542, and the audio test files 580. Alternatively, the master test word files 522 may be obtained from an existing master source. The test administrator may record the master test words shown in FIG. 3 or may record the master test phrases shown in FIG. 4 using the audio recording system (Act 1102). Multiple versions of the same word may be recorded using professional or trained speakers in different age groups, and gender. These recordings may be made in an ideally controlled audio environment, such as in an anechoic chamber or other controlled environment. The master test word files 522 may be saved as WAV files in the database (Act 1106).

The test administrator may record various noise effects using the audio recording system (Act 1110). The noise effects may be recorded in different environments, such as in different models of vehicles. The noise effects may be specifically directed to a particular vehicle or model of vehicle because the audio processing or noise reduction technique may be directed to that vehicle or model. Noise effects, such as fan noise, blower noise, rain noise, wind buffets, engine noise, road noise, windshield wiper noise, and tire noise may be recorded in a plurality of different vehicle types and models. The recorded noise files may be saved in the database 120 as master noise-effects files 532 in WAV format (Act 1120).

The combining circuit 560 may combine or convolute some or all of the master noise-effects files 532 with each of the master test word files 522 to generate master noise-affected test word files 542 (Act 1122). Various combinations and permeations may be recorded. The master noise-affected test files 542 may represent how ideal or perfect speech (the master spoken test words) are degraded by noise and environmental effects and may be saved in the database (Act 1130).

The master noise-affected test word files 542 may be subjected to various audio processing or noise reduction techniques, such as echo-cancellation, echo-suppression, gain level adjustment, bandwidth extension, dynamic range modification, and other techniques to determine the effectiveness of such audio processing and noise reduction (Act 1140). The audio processing/noise reduction system 570 may process selected master noise-affected test word files 542 to generate the audio test word files 580. Processing may be performed using actual noise-reduction/processing hardware and/or software for which effectiveness evaluation is desired The administrator may select a subset of the audio test word files 580 for a particular test. For example, although the DRT may include 192 different words, one specific DRT may include 42 audio test words for downloading to permit the test to be completed within the predetermined period of time. Some of the selected 42 words, for example, may include blower noise found in a specific vehicle model, where the blower noise may be reduced or processed by a first digital noise-reduction process. Other test words in the group of 42 words may be processed by a second digital noise-reduction process. Presentation of the audio test word files may be randomized. The results of the test may indicate that words processed by the first digital noise-reduction process are generally more intelligible to the particular client (or to many clients) than words processed by the second digital noise reduction process.

In the distributed intelligibility testing system 100, the same test set may be used for each client 250, but in a randomized play back manner. Alternatively, a randomly selected test set may be chosen for each client 250, and again presented in a randomized play back order. Such varying of the test sets may be useful when investigating the performance of a process or algorithm over a wide range of phonetic content, whereas a standard test set may be useful if a process or algorithm is being tested for artifacts that are observed for a particular phonetic content. A varied set may be useful when attempting to prove equivalence between two code versions, for example. A varied test set may produce intelligibility scores among a listening population that have a greater variability than it would have if the test set were identical for each client, due to the particular phonetic content, because some content is more difficult to discern than other content.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method for administering a standardized audio test to a plurality of remotely located clients, the method comprising:

providing a plurality of audio test words based on established intelligibility standards;

storing the audio test words as a plurality of audio test files in a database;

for each respective remotely located client:

a. downloading from the database, the audio test files and a test protocol corresponding to the audio test files;

b. playing the audio test files according to the test protocol;

c. recording test responses made in response to the playing of the audio test files;

d. uploading the test responses to the database; and processing the test responses stored in the database to determine results of the test from each of the respective remotely located client.

2. The method of claim 1, where providing the audio test words comprises:

recording a plurality of spoken master test words based on established intelligibility standards;

combining the spoken master test words with predetermined noise effects to generate noise affected test words; and applying a noise correction process to the noise affected test words to generate the audio test words.

3. The method of claim 2, where results of the test responses indicate a level of effectiveness of the applied noise correction process as measured by a level of intelligibility of the audio test words.

4. The method of claim 3, where the level of intelligibility of the audio test words comprises a measure of whether the test responses are correct.

5. The method of claim 2, where the noise correction process applied increases a level of intelligibility of the audio test words by partially or substantially countering the noise effects.

6. The method of claim 2, where the predetermined noise effects are selected from the group consisting of fan noise, blower noise, rain noise, wind buffets, engine noise, road noise, windshield wiper noise, and tire noise.

7. The method of claim 2, where the respective client communicates with the database remotely through a communication network.

8. The method of claim 1, where the client communicates with a database closest to the client to reduce a downloading time of the audio test files.

9. The method of claim 1, where a plurality of audio test words are grouped together and played as an audio test phrase.

10. A method for administering a standardized audio test to a plurality of remotely located clients, the test prepared by a test administrator, the method comprising:

recording a plurality of spoken master test words based on established intelligibility standards;

combining the spoken master test words with predetermined noise effects to generate noise affected test words;

applying a noise correction process to the noise affected test words to generate a plurality of audio test words;

storing the audio test words as a plurality of audio test files in a database; for each respective client:

a. downloading from the database, the audio test files and a test protocol corresponding to the audio test files;

b. playing the audio test files according to the test protocol;

c. recording test responses made in response to the playing of the audio test files;

d. storing the test responses in the database; and processing the test responses by the test administrator to determine effectiveness of the applied noise correction process.

11. The method of claim 10, where results of the test responses indicate a level of effectiveness of the applied noise correction process.

12. The method of claim 10, where the predetermined noise effects are selected from the group consisting of fan noise, blower noise, rain noise, wind buffets, engine noise, road noise, windshield wiper noise, and tire noise.

13. The method of claim 10, where the respective client communicates with the database remotely through a communication network.

14. The method of claim 13, where the communication network is the Internet.

15. The method of claim 10, where the client communicates with a database closest to the client to reduce a downloading time of the audio test files.

16. A computer-readable storage medium having processor executable instructions to administer a standardized audio test to a plurality of remotely located clients, by performing the acts of:

generating a plurality of audio test words based on established intelligibility standards;

storing the audio test words as a plurality of audio test files in a database;

for each respective client:

a. downloading from the database, the audio test files and a test protocol corresponding to the audio test files, where each respective client downloads from the database closest to that client to reduce a downloading time;

b. playing the audio test files according to the test protocol;

c. recording test responses made in response to the playing of the audio test files;

d. saving the test responses to the database; and processing the test responses to determine results of the test.

17. The computer-readable storage medium of claim 16, further comprising processor executable instructions that cause a processor to perform the acts of:

recording a plurality of spoken master test words based on established intelligibility standards;

combining the spoken master test words with predetermined noise effects to generate noise affected test words; and applying a noise correction process to the noise affected test words to generate the audio test words.

18. A distributed intelligibility testing system for providing a standardized audio test to a plurality of remotely located client systems, the system comprising:

a test manager configured to record a plurality of audio test words based on established intelligibility standards and generate a test protocol corresponding to the audio test words;

a database configured to receive and store the audio test words and the test protocol, the audio test words stored as a plurality of audio test files;

the respective remotely located client system in communication with the database and configured to download and play the audio test files in accordance with the test protocol;

the respective client system configured to record test responses made in response to the playing of the audio test files, and upload the test responses to the database; and where the test manager is configured to process the test responses stored in the database from each of the respective remotely located client systems.

19. The system of claim 18, comprising for each client system, a sound processing card and a headphone set in communication with the sound processing card.

20. The system of claim 19, where the spoken audio test words are combined with predetermined noise effects to generate noise affected test words, and a noise correction process is applied to the noise affected test words to generate the audio test words.

21. The system of claim 20, comprising a test results analyzer configured to analyze the test responses and determine a level of effectiveness of the applied noise correction process, where the level of effectiveness of the applied noise correction process is directly proportional to a level of intelligibility of the audio test words.

22. The system of claim 21, where the level of intelligibility of the audio test words comprises a percentage of correct test responses.

23. The system of claim 20, where the predetermined noise effects are selected from the group consisting of fan noise, blower noise, rain noise, wind buffets, engine noise, road noise, windshield wiper noise, and tire noise.

24. The system of claim 19, where the sound processing card is controlled to provide the headphone set with an audio signal having a predetermined volume level and flat frequency profile.

* * * * *